US009779889B2

(12) United States Patent
Yarak, III et al.

(10) Patent No.: US 9,779,889 B2
(45) Date of Patent: Oct. 3, 2017

(54) SCISSOR MECHANISM FEATURES FOR A KEYBOARD

(71) Applicant: Apple Inc., Cupertino, CA (US)

(72) Inventors: William P. Yarak, III, Cupertino, CA (US); Euan S. Abraham, Cupertino, CA (US); Erik T. Stefansson, Cupertino, CA (US); John M. Brock, San Carlos, CA (US)

(73) Assignee: APPLE INC., Cupertino, CA (US)

( * ) Notice: Subject to any disclaimer, the term of this patent is extended or adjusted under 35 U.S.C. 154(b) by 136 days.

(21) Appl. No.: 14/667,117

(22) Filed: Mar. 24, 2015

(65) Prior Publication Data

US 2015/0270073 A1 Sep. 24, 2015

Related U.S. Application Data

(60) Provisional application No. 61/969,405, filed on Mar. 24, 2014.

(51) Int. Cl.
*H01H 3/12* (2006.01)
*H01H 13/70* (2006.01)

(52) U.S. Cl.
CPC ..... *H01H 3/125* (2013.01); *H01H 13/70* (2013.01); *H01H 2215/006* (2013.01); *Y10T 29/49105* (2015.01)

(58) Field of Classification Search
CPC ..... H01H 3/12; H01H 13/70; H01H 13/14
USPC ..... 200/5 A, 341, 344
See application file for complete search history.

(56) References Cited

U.S. PATENT DOCUMENTS

| | | | |
|---|---|---|---|
| 3,657,492 | A | 4/1972 | Arndt et al. |
| 3,917,917 | A | 11/1975 | Murata |
| 4,095,066 | A | 6/1978 | Harris |
| 4,319,099 | A | 3/1982 | Asher |
| 4,349,712 | A | 9/1982 | Michalski |
| 4,484,042 | A | 11/1984 | Matsui |
| 4,937,408 | A | 6/1990 | Hattori et al. |
| 5,136,131 | A | 8/1992 | Komaki |
| 5,278,372 | A | 1/1994 | Takagi et al. |

(Continued)

FOREIGN PATENT DOCUMENTS

| | | |
|---|---|---|
| CN | 2155620 | 2/1994 |
| CN | 2394309 | 8/2000 |

(Continued)

OTHER PUBLICATIONS

U.S. Appl. No. 14/472,260, filed Aug. 28, 2014, pending.

(Continued)

*Primary Examiner* — Edwin A. Leon
*Assistant Examiner* — Iman Malakooti
(74) *Attorney, Agent, or Firm* — Brownstein Hyatt Farber Schreck, LLP

(57) ABSTRACT

A key supported by a scissor mechanism including interlocking scissor members assembled to mutually pivot along a pivot track. A first scissor member may include a pivot track and an up-stop track and a second scissor member may include at least a first and second extension portion positioned within the pivot track and the up-stop track respectively. When the key is depressed, the first extension portion may slide and at least partially pivot or rotate within the pivot track, and the second extension portion may slide within the up-stop track.

20 Claims, 6 Drawing Sheets

(56) References Cited

U.S. PATENT DOCUMENTS 5,340,955 A 8/1994 Calvillo et al.
5,382,762 A 1/1995 Mochizuki
5,408,060 A 4/1995 Muurinen
5,421,659 A 6/1995 Liang
5,422,447 A 6/1995 Spence
5,457,297 A 10/1995 Chen
5,481,074 A 1/1996 English
5,504,283 A 4/1996 Kako et al.
5,512,719 A 4/1996 Okada et al.
5,625,532 A 4/1997 Sellers
5,804,780 A 9/1998 Bartha
5,828,015 A 10/1998 Coulon
5,847,337 A 12/1998 Chen
5,874,700 A 2/1999 Hochgesang
5,878,872 A 3/1999 Tsai
5,898,147 A 4/1999 Domzaiski et al.
5,924,555 A 7/1999 Sadamori et al.
5,935,691 A 8/1999 Tsai
5,986,227 A 11/1999 Hon
6,020,565 A 2/2000 Pan
6,068,416 A 5/2000 Kumamoto et al.
6,215,420 B1 4/2001 Harrison et al.
6,257,782 B1 7/2001 Maruyama et al.
6,388,219 B2 5/2002 Hsu et al.
6,423,918 B1 7/2002 King et al.
6,482,032 B1 11/2002 Szu et al.
6,538,801 B2 3/2003 Jacobson et al.
6,542,355 B1 4/2003 Huang
6,556,112 B1 4/2003 Van Zeeland et al.
6,559,399 B2 5/2003 Hsu et al.
6,572,289 B2 6/2003 Lo et al.
6,624,369 B2 9/2003 Ito et al.
6,759,614 B2 7/2004 Yoneyama
6,762,381 B2 7/2004 Kunthady et al.
6,765,503 B1 7/2004 Chan et al.
6,788,450 B2 9/2004 Kawai et al.
6,797,906 B2 9/2004 Ohashi
6,850,227 B2 2/2005 Takahashi et al.
6,940,030 B2 9/2005 Takeda et al.
6,977,352 B2 12/2005 Oosawa
6,979,792 B1 12/2005 Lai
6,987,466 B1 1/2006 Welch et al.
6,987,503 B2 1/2006 Inoue
7,012,206 B2 3/2006 Oikawa
7,038,832 B2 5/2006 Kanbe
7,129,930 B1 10/2006 Cathey et al.
7,134,205 B2 11/2006 Bruennel
7,151,236 B2 12/2006 Ducruet et al.
7,154,059 B2 12/2006 Chou
7,172,303 B2 2/2007 Shipman et al.
7,256,766 B2 8/2007 Albert et al.
7,283,119 B2 10/2007 Kishi
7,301,113 B2 11/2007 Nishimura et al.
7,378,607 B2 5/2008 Koyano et al.
7,414,213 B2 8/2008 Hwang
7,429,707 B2 9/2008 Yanai et al.
7,432,460 B2 10/2008 Clegg
7,510,342 B2 3/2009 Lane et al.
7,531,764 B1 5/2009 Lev et al.
7,541,554 B2 6/2009 Hou
7,639,187 B2 12/2009 Caballero et al.
7,781,690 B2 8/2010 Ishii
7,813,774 B2 10/2010 Perez-Noguera
7,842,895 B2 11/2010 Lee
7,847,204 B2 12/2010 Tsai
7,851,819 B2 12/2010 Shi
7,866,866 B2 1/2011 Wahlstrom
7,947,915 B2 5/2011 Lee et al.
7,999,748 B2 8/2011 Ligtenberg et al.
8,063,325 B2 11/2011 Sung et al.
8,080,744 B2 12/2011 Yeh et al.
8,109,650 B2 2/2012 Chang et al.
8,119,945 B2 2/2012 Lin
8,124,903 B2 2/2012 Tatehata et al.
8,134,094 B2 3/2012 Tsao et al.
8,143,982 B1 3/2012 Lauder et al.
8,156,172 B2 4/2012 Muehl et al.
8,178,808 B2 5/2012 Strittmatter et al.
8,212,160 B2 7/2012 Tsao
8,212,162 B2 7/2012 Zhou
8,218,301 B2 7/2012 Lee
8,232,958 B2 7/2012 Tolbert
8,253,048 B2 8/2012 Ozias et al.
8,253,052 B2 8/2012 Chen
8,263,887 B2 9/2012 Chen et al.
8,289,280 B2 10/2012 Travis
8,299,382 B2 10/2012 Takemae et al.
8,319,298 B2 11/2012 Hsu
8,330,725 B2 12/2012 Mahowald et al.
8,354,629 B2 1/2013 Lin
8,378,857 B2 2/2013 Pance
8,384,566 B2 2/2013 Bocirnea
8,436,265 B2 5/2013 Koike et al.
8,451,146 B2 5/2013 Mahowald et al.
8,462,514 B2 6/2013 Myers et al.
8,500,348 B2 8/2013 Dumont et al.
8,502,094 B2 8/2013 Chen
8,542,194 B2 9/2013 Akens et al.
8,569,639 B2 10/2013 Strittmatter
8,581,127 B2 11/2013 Jhuang et al.
8,592,699 B2 11/2013 Kessler et al.
8,592,702 B2 11/2013 Tsai
8,592,703 B2 11/2013 Johnson et al.
8,604,370 B2 12/2013 Chao
8,629,362 B1 1/2014 Knighton et al.
8,642,904 B2 2/2014 Chiba et al.
8,651,720 B2 2/2014 Sherman et al.
8,659,882 B2 2/2014 Liang et al.
8,731,618 B2 5/2014 Jarvis et al.
8,748,767 B2 6/2014 Ozias et al.
8,759,705 B2 6/2014 Funakoshi et al.
8,760,405 B2 6/2014 Nam
8,786,548 B2 7/2014 Oh et al.
8,791,378 B2 7/2014 Lan
8,835,784 B2 9/2014 Hirota
8,847,711 B2 9/2014 Yang et al.
8,853,580 B2 10/2014 Chen
8,854,312 B2 10/2014 Meierling
8,870,477 B2 10/2014 Merminod et al.
8,884,174 B2 11/2014 Chou et al.
8,921,473 B1 12/2014 Hyman
8,922,476 B2 12/2014 Stewart et al.
8,976,117 B2 3/2015 Krahenbuhl et al.
8,994,641 B2 3/2015 Stewart et al.
9,007,297 B2 4/2015 Stewart et al.
9,012,795 B2 4/2015 Niu et al.
9,029,723 B2 5/2015 Pegg
9,063,627 B2 6/2015 Yairi et al.
9,064,642 B2 6/2015 Welch et al.
9,086,733 B2 7/2015 Pance
9,087,663 B2 7/2015 Los
9,093,229 B2 7/2015 Leong et al.
9,213,416 B2 12/2015 Chen
9,223,352 B2 12/2015 Smith et al.
9,234,486 B2 1/2016 Das et al.
9,235,236 B2 1/2016 Nam
9,275,810 B2 3/2016 Pance et al.
9,300,033 B2 3/2016 Han et al.
9,305,496 B2 4/2016 Kimura
9,443,672 B2 9/2016 Martisauskas
9,477,382 B2 10/2016 Hicks et al.
2002/0079211 A1 6/2002 Katayama et al.
2002/0093436 A1 7/2002 Lien
2002/0149835 A1 10/2002 Kanbe
2003/0169232 A1 9/2003 Ito
2003/0213685 A1* 11/2003 Hsu ..... H01H 13/20
200/344
2004/0257247 A1 12/2004 Lin et al.
2006/0011458 A1 1/2006 Purcocks
2006/0020469 A1 1/2006 Rast
2006/0120790 A1 6/2006 Chang
2006/0181511 A1 8/2006 Woolley
2006/0243987 A1 11/2006 Lai
2007/0200823 A1 8/2007 Bytheway et al.

(56) References Cited

U.S. PATENT DOCUMENTS

| | | | |
|---|---|---|---|
| 2007/0285393 | A1 | 12/2007 | Ishakov |
| 2008/0136782 | A1 | 6/2008 | Mundt et al. |
| 2008/0251370 | A1 | 10/2008 | Aoki |
| 2009/0046053 | A1 | 2/2009 | Shigehiro et al. |
| 2009/0103964 | A1 | 4/2009 | Takagi et al. |
| 2009/0128496 | A1 | 5/2009 | Huang |
| 2009/0262085 | A1 | 10/2009 | Wassingbo et al. |
| 2010/0066568 | A1 | 3/2010 | Lee |
| 2010/0109921 | A1 | 5/2010 | Annerfors |
| 2010/0156796 | A1 | 6/2010 | Kim et al. |
| 2010/0253630 | A1 | 10/2010 | Homma et al. |
| 2010/0307902 | A1* | 12/2010 | Chen ..... H01H 3/125 200/344 |
| 2011/0032127 | A1 | 2/2011 | Roush |
| 2011/0056817 | A1 | 3/2011 | Wu |
| 2011/0056836 | A1 | 3/2011 | Tatebe et al. |
| 2011/0205179 | A1 | 8/2011 | Braun |
| 2011/0267272 | A1 | 11/2011 | Meyer et al. |
| 2011/0303521 | A1 | 12/2011 | Niu et al. |
| 2012/0012446 | A1 | 1/2012 | Hwa |
| 2012/0090973 | A1 | 4/2012 | Liu |
| 2012/0098751 | A1 | 4/2012 | Liu |
| 2012/0286701 | A1 | 11/2012 | Yang et al. |
| 2012/0298496 | A1 | 11/2012 | Zhang |
| 2012/0313856 | A1 | 12/2012 | Hsieh |
| 2013/0100030 | A1 | 4/2013 | Los et al. |
| 2013/0161170 | A1 | 6/2013 | Fan et al. |
| 2013/0270090 | A1 | 10/2013 | Lee |
| 2014/0027259 | A1 | 1/2014 | Kawana et al. |
| 2014/0071654 | A1 | 3/2014 | Chien |
| 2014/0090967 | A1 | 4/2014 | Inagaki |
| 2014/0098042 | A1 | 4/2014 | Kuo et al. |
| 2014/0116865 | A1 | 5/2014 | Leong et al. |
| 2014/0118264 | A1 | 5/2014 | Leong et al. |
| 2014/0151211 | A1 | 6/2014 | Zhang |
| 2014/0184496 | A1 | 7/2014 | Gribetz et al. |
| 2014/0218851 | A1 | 8/2014 | Klein et al. |
| 2014/0252881 | A1 | 9/2014 | Dinh et al. |
| 2014/0291133 | A1 | 10/2014 | Fu et al. |
| 2014/0320436 | A1 | 10/2014 | Modarres et al. |
| 2014/0346025 | A1 | 11/2014 | Hendren et al. |
| 2014/0375141 | A1 | 12/2014 | Nakajima |
| 2015/0016038 | A1 | 1/2015 | Niu et al. |
| 2015/0083561 | A1 | 3/2015 | Han et al. |
| 2015/0090570 | A1 | 4/2015 | Kwan et al. |
| 2015/0090571 | A1 | 4/2015 | Leong et al. |
| 2015/0227207 | A1 | 8/2015 | Winter et al. |
| 2015/0243457 | A1 | 8/2015 | Niu et al. |
| 2015/0277559 | A1 | 10/2015 | Vescovi et al. |
| 2015/0287553 | A1 | 10/2015 | Welch et al. |
| 2015/0332874 | A1 | 11/2015 | Brock et al. |
| 2015/0348726 | A1 | 12/2015 | Hendren |
| 2015/0378391 | A1 | 12/2015 | Huitema et al. |
| 2016/0049266 | A1 | 2/2016 | Stringer et al. |
| 2016/0093452 | A1 | 3/2016 | Zercoe et al. |
| 2016/0172129 | A1 | 6/2016 | Zercoe et al. |
| 2016/0189890 | A1 | 6/2016 | Leong et al. |
| 2016/0189891 | A1 | 6/2016 | Zercoe et al. |

FOREIGN PATENT DOCUMENTS

| | | |
|---|---|---|
| CN | 1533128 | 9/2004 |
| CN | 1542497 | 11/2004 |
| CN | 2672832 | 1/2005 |
| CN | 1624842 | 6/2005 |
| CN | 1812030 | 8/2006 |
| CN | 1855332 | 11/2006 |
| CN | 101051569 | 10/2007 |
| CN | 200986871 | 12/2007 |
| CN | 101146137 | 3/2008 |
| CN | 201054315 | 4/2008 |
| CN | 201084602 | 7/2008 |
| CN | 201123174 | 9/2008 |
| CN | 201149829 | 11/2008 |
| CN | 101315841 | 12/2008 |
| CN | 201210457 | 3/2009 |
| CN | 101465226 | 6/2009 |
| CN | 101494130 | 7/2009 |
| CN | 101502082 | 8/2009 |
| CN | 201298481 | 8/2009 |
| CN | 101546667 | 9/2009 |
| CN | 101572195 | 11/2009 |
| CN | 101800281 | 8/2010 |
| CN | 101807482 | 8/2010 |
| CN | 201655616 | 11/2010 |
| CN | 102110542 | 6/2011 |
| CN | 102119430 | 7/2011 |
| CN | 201904256 | 7/2011 |
| CN | 102163084 | 8/2011 |
| CN | 201927524 | 8/2011 |
| CN | 201945951 | 8/2011 |
| CN | 201945952 | 8/2011 |
| CN | 201956238 | 8/2011 |
| CN | 102197452 | 9/2011 |
| CN | 202008941 | 10/2011 |
| CN | 202040690 | 11/2011 |
| CN | 102280292 | 12/2011 |
| CN | 102375550 | 3/2012 |
| CN | 102496509 | 6/2012 |
| CN | 10269527 | 8/2012 |
| CN | 202372927 | 8/2012 |
| CN | 102683072 | 9/2012 |
| CN | 202434387 | 9/2012 |
| CN | 102955573 | 3/2013 |
| CN | 102956386 | 3/2013 |
| CN | 103000417 | 3/2013 |
| CN | 103165327 | 6/2013 |
| CN | 103180979 | 6/2013 |
| CN | 103377841 | 10/2013 |
| CN | 103489986 | 1/2014 |
| CN | 103681056 | 3/2014 |
| CN | 203520312 | 4/2014 |
| CN | 203588895 | 5/2014 |
| CN | 103839715 | 6/2014 |
| CN | 103839722 | 6/2014 |
| CN | 103903891 | 7/2014 |
| CN | 103956290 | 7/2014 |
| CN | 204102769 | 1/2015 |
| DE | 2530176 | 1/1977 |
| DE | 3002772 | 7/1981 |
| DE | 29704100 | 4/1997 |
| EP | 0441993 | 8/1991 |
| EP | 1835272 | 9/2007 |
| EP | 1928008 | 6/2008 |
| EP | 2022606 | 6/2010 |
| EP | 2426688 | 3/2012 |
| EP | 2664979 | 11/2013 |
| FR | 2147420 | 3/1973 |
| FR | 2911000 | 7/2008 |
| FR | 2950193 | 3/2011 |
| GB | 1361459 | 7/1974 |
| JP | S50115562 | 9/1975 |
| JP | S60055477 | 3/1985 |
| JP | 61172422 | 10/1986 |
| JP | S62072429 | 4/1987 |
| JP | 63182024 | 11/1988 |
| JP | H0422024 | 4/1992 |
| JP | H0520963 | 1/1993 |
| JP | 0524512 | 8/1993 |
| JP | H09204148 | 8/1997 |
| JP | 10312726 | 11/1998 |
| JP | H11194882 | 7/1999 |
| JP | 2000057871 | 2/2000 |
| JP | 2000339097 | 12/2000 |
| JP | 2001100889 | 4/2001 |
| JP | 2002260478 | 9/2002 |
| JP | 2002298689 | 10/2002 |
| JP | 2003522998 | 7/2003 |
| JP | 2005108041 | 4/2005 |
| JP | 2006164929 | 6/2006 |
| JP | 2006185906 | 7/2006 |
| JP | 2006521664 | 9/2006 |
| JP | 2006269439 | 10/2006 |

(56) References Cited

FOREIGN PATENT DOCUMENTS

| | | |
|---|---|---|
| JP | 2006277013 | 10/2006 |
| JP | 2006344609 | 12/2006 |
| JP | 2007115633 | 5/2007 |
| JP | 2007514247 | 5/2007 |
| JP | 2007156983 | 6/2007 |
| JP | 2008021428 | 1/2008 |
| JP | 2008100129 | 5/2008 |
| JP | 2008191850 | 8/2008 |
| JP | 2008533559 | 8/2008 |
| JP | 2009181894 | 8/2009 |
| JP | 2010061956 | 3/2010 |
| JP | 2010244088 | 10/2010 |
| JP | 2010244302 | 10/2010 |
| JP | 2011065126 | 3/2011 |
| JP | 2011150804 | 8/2011 |
| JP | 2011165630 | 8/2011 |
| JP | 2011524066 | 8/2011 |
| JP | 2012043705 | 3/2012 |
| JP | 2012063630 | 3/2012 |
| JP | 201298873 | 5/2012 |
| JP | 2012134064 | 7/2012 |
| JP | 2012186067 | 9/2012 |
| JP | 2012230256 | 11/2012 |
| JP | 2014017179 | 1/2014 |
| JP | 2014216190 | 11/2014 |
| JP | 2014220039 | 11/2014 |
| KR | 20150024201 | 3/2015 |
| TW | 200703396 | 1/2007 |
| TW | M334397 | 6/2008 |
| TW | 201108284 | 3/2011 |
| TW | 201108286 | 3/2011 |
| TW | M407429 | 7/2011 |
| TW | 201246251 | 11/2012 |
| TW | 201403646 | 1/2014 |
| WO | WO9744946 | 11/1997 |
| WO | WO2005/057320 | 6/2005 |
| WO | WO2006/022313 | 3/2006 |
| WO | WO2008/045833 | 4/2008 |
| WO | WO2009/005026 | 1/2009 |
| WO | WO2012/011282 | 1/2012 |
| WO | WO2012/027978 | 3/2012 |
| WO | WO2014175446 | 10/2014 |

OTHER PUBLICATIONS

U.S. Appl. No. 14/501,680, filed Sep. 30, 2014, pending.
U.S. Appl. No. 14/736,151, filed Jun. 10, 2015, pending.
U.S. Appl. No. 14/765,145, filed Jul. 31, 2015, pending.
U.S. Appl. No. 14/826,590, filed Aug. 14, 2015, pending.
U.S. Appl. No. 14/867,598, filed Sep. 28, 2015, pending.
U.S. Appl. No. 14/867,672, filed Sep. 28, 2015, pending.
U.S. Appl. No. 14/867,712, filed Sep. 28, 2015, pending; and.
U.S. Appl. No. 14/867,746, filed Sep. 28, 2015, pending.
Elekson, "Reliable and Tested Wearable Electronics Embedment Solutions," http://www.wearable.technology/our—technologies, 3 pages, at least as early as Jan. 6, 2016.
U.S. Appl. No. 15/014,596, filed Feb. 3, 2016, pending.
U.S. Appl. No. 15/154,682, filed May 13, 2016, pending.
U.S. Appl. No. 15/154,706, filed May 13, 2016, pending.
U.S. Appl. No. 15/154,723, filed May 13, 2016, pending.
U.S. Appl. No. 15/154,768, filed May 13, 2016, pending.
U.S. Appl. No. 15/230,740, filed Aug. 8, 2016, pending.
U.S. Appl. No. 15/230,724, filed Aug. 8, 2016, pending.
U.S. Appl. No. 15/261,954, filed Sep. 11, 2016, pending.
U.S. Appl. No. 15/261,972, filed Sep. 11, 2016, pending.
U.S. Appl. No. 15/262,249, filed Sep. 12, 2016, pending.
U.S. Appl. No. 15/264,827, filed Sep. 14, 2016, pending.
U.S. Appl. No. 15/268,518, filed Sep. 16, 2016, pending.
U.S. Appl. No. 15/269,790, filed Sep. 19, 2016, pending.

* cited by examiner

SCISSOR MECHANISM FEATURES FOR A KEYBOARD

CROSS-REFERENCE TO RELATED APPLICATION

This application is a nonprovisional patent application of and claims the benefit to U.S. Provisional Patent Application No. 61/969,405, filed Mar. 24, 2014 and titled "Scissor Mechanism Features for a Keyboard," the disclosure of which is hereby incorporated herein by reference in its entirety.

TECHNICAL FIELD

Embodiments described herein generally relate to structural support systems for depressible keys of a keyboard and, more particularly, to a keyboard having keys supported by an interlocking scissor mechanism.

BACKGROUND

Many electronic devices receive user input from a keyboard. Traditionally, keyboards include several rows of depressible keys spaced some distance apart. The distance between keys may be selected for aesthetic, functional, structural, dimensional or other reasons. For example, space-constrained electronic devices such as laptop computers may include an integrated keyboard with closely spaced keys.

In some examples, close spacing of keys may heighten user awareness of subtle differences between adjacent keys. For example, color, texture, or height differences may become more apparent the closer individual keys are arranged. Such perceivable differences between keys, especially height differences, may negatively affect the typing experience.

In many cases, the height of a key may be defined by a multi-part mechanical scissor mechanism also used to translate the key downward a selected distance. Conventional scissor mechanisms may include two scissor members coupled to pivot about a midpoint, with a foot portion of one or both of the scissor members able to slide a certain distance during depression of the key. Once the key is released, the foot portion may slide back, returning the key to the upper height. In this manner, the sliding distance of the foot portion may define the height of the key. Accordingly, to ensure uniform height of closely spaced keys having mechanical scissor mechanisms, each scissor member of each key may require exceptionally low manufacturing tolerance, as slight differences in the dimension of the scissor members may translate to perceivable differences in upper height of adjacent keys. In many cases, low manufacturing tolerances may substantially increase the cost of manufacture by increasing rejection rates, material costs, and manufacture time.

Accordingly, there may be a present need for improved mechanical scissor mechanisms for keyboards requiring uniform height of adjacent keys.

SUMMARY

Embodiments described herein may relate to or take the form of a keyboard including at least a plurality of keys with each key including at least a keycap, a scissor mechanism disposed below the keycap, an elastomeric dome disposed at least partially below the scissor mechanism, and electronic switch circuitry disposed below the elastomeric dome.

In these embodiments, the scissor mechanism may include at least a first scissor member defining a pivot track and an up-stop track and a second scissor member including at least a first and second extension portion. The first extension portion may be positioned within the pivot track and a second extension portion may be positioned within the up-stop track. In certain embodiments, each keycap may also include a retaining feature to pivotally interface with an end portion of the second scissor member.

Some embodiments may include a configuration in including a baseplate disposed below the plurality of keys that may include retaining features to pivotally interface with an end portion of a respective first scissor member.

In certain embodiments, the pivot track of may be at least partially curved or in other examples, the pivot track may be at least partially angled with respect to a bottom surface of the respective first scissor member.

In certain embodiments, the second scissor member may be sized to at least partially fit within an aperture within the first scissor member or, in the alternative, the first scissor member may be sized to at least partially fit within an aperture within the second scissor member. In still further embodiments, the first and second members may partially overlap one another.

Further embodiments described herein may relate to, include, or take the form of a keyboard including at least a plurality of keys each including a scissor mechanism. the scissor mechanism may include at least a first scissor member including a pivot track and a second scissor member including at least an extension portion. The extension portion may be positioned within the pivot track. In certain embodiments, each keycap may also include a retaining feature to pivotally interface with an end portion of the second scissor member.

Some embodiments described herein may relate to or take the form of methods of assembling a key including at least the steps of providing a base plate including at least a first and second retaining feature, positioning a membrane over the base plate, positioning over the membrane a scissor mechanism including at least a first scissor member with a pivot track and an up-stop track, and a second scissor member including at least a first extension portion positioned within the pivot track and a second extension portion positioned within the up-stop track, aligning a first end of the first scissor member with the first retaining feature, and aligning a first end of the second scissor member with the second retaining feature.

BRIEF DESCRIPTION OF THE FIGURES

Reference will now be made to representative embodiments illustrated in the accompanying figures. It should be understood that the following descriptions are not intended to limit the embodiments to one preferred embodiment. To the contrary, it is intended to cover alternatives, modifications, and equivalents as may be included within the spirit and scope of the described embodiments as defined by the appended claims.

The use of the same or similar reference numerals in different figures indicates similar, related, or identical items.

DETAILED DESCRIPTION

Embodiments described herein may relate to or take the form of a key having a scissor mechanism including interlocking scissor members assembled to pivot along a track. It should be appreciated that the various embodiments described herein, as well as functionality, operation, components, and capabilities thereof may be combined with other elements as necessary, and so any physical, functional, or operational discussion of any element or feature is not intended to be limited solely to a particular embodiment to the exclusion of others.

For embodiments described herein, a first scissor member may define a pivot track and an up-stop track and a second scissor member may include at least a first and second extension portion positioned within the pivot track and the up-stop track respectively. In this manner, when the key cap is depressed, the first extension portion may slide and at least partially pivot or rotate within the pivot track, and the second extension portion may slide within the up-stop track.

Upon release of the key, the first extension portion may slide and at least partially pivot in the opposite direction within the pivot track and the second extension portion may move in the opposite direction within the up-stop track. After a certain travel distance, the second extension portion may reach the end of the up-stop track and may be arrested from traveling further. In this manner, the position of the end of the up-stop track may define the upper height of the key. In other words, the up-stop track may rigidly limit the height of the top of the key when the key is uncompressed or otherwise in the "up" position.

In these and related embodiments, the up-stop may independently define the height of the key and the pivot track may define a pivot path for the scissor mechanisms to collapse with respect to one another.

Certain embodiments may not necessarily include an up-stop track. For example, the pivot track may by itself be used to exclusively define a pivot path for the scissor members and may be used to define the upper height of the key and/or extension of the scissor members. In other words, the pivot track may rigidly limit the height of the top of the key when the key is uncompressed or otherwise in the "up" position.

Likewise, certain embodiments may not include a pivot track. For example, the up-stop track may by itself define and rigidly limit the height of the top of the key when the key is uncompressed or otherwise in the "up" position. In this manner, the up-stop track may be included within a standard fixed pivot point scissor mechanism.

Figure 1:
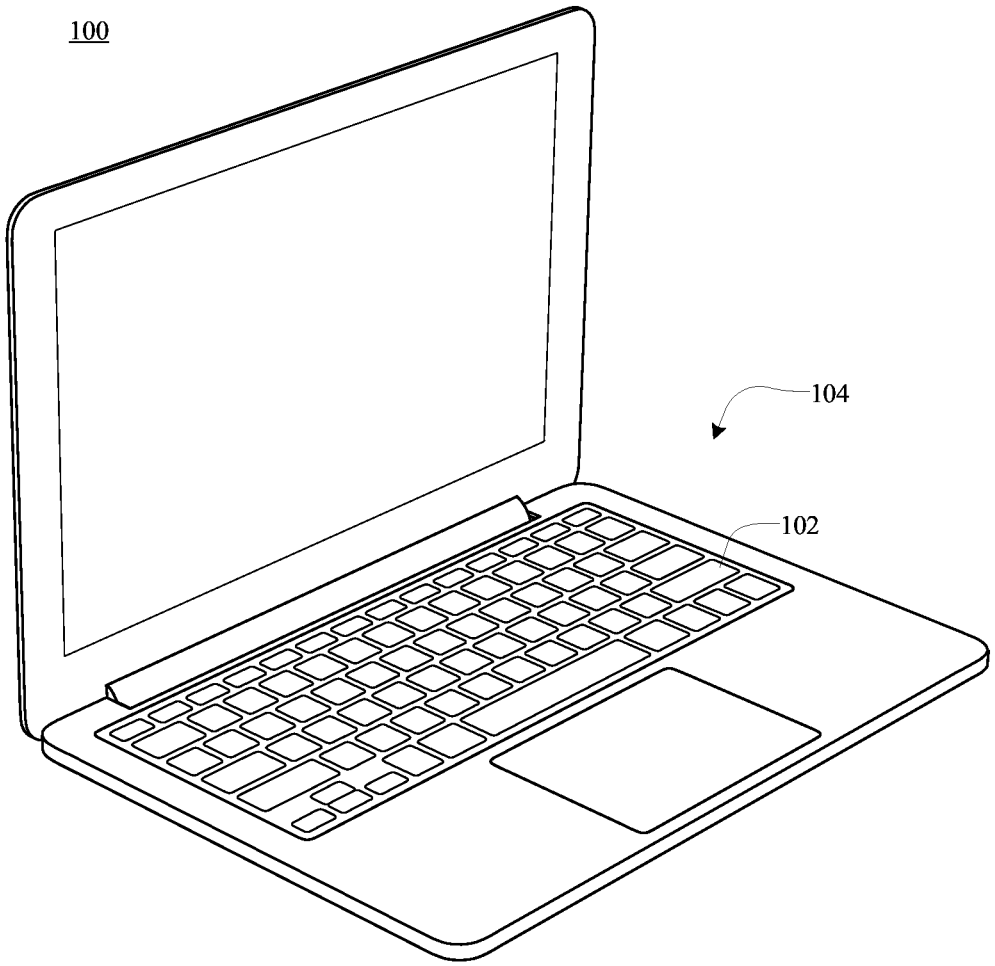
FIG. 1 depicts a perspective view of a sample electronic device.

FIG. 1 depicts a perspective view of a sample electronic device 100 including a plurality of keys 102. As depicted, the electronic device 100 is a portable laptop computer including an integrated keyboard 104 including a plurality of rows of keys 102. Each key 102 may include a key stack defined by at least a key cap, a scissor mechanism, a elastomeric dome, and electronic switch circuitry. Each key 102 may be configured to depress a certain select distance (e.g., 1.0 mm). In many embodiments, the electronic device 100 may be a laptop computer as shown, although it may be appreciated that other electronic devices are contemplated. For example, a key including a scissor mechanism may be included within an electronic device such as a cellular phone, smart phone, tablet computer, desktop computer, peripheral input device (e.g., peripheral keyboard, mouse, or track pad), wearable device, health device, and so on. In other examples, the key may be a discrete electronic part for inclusion within a number of circuits or devices.

Figure 2A:
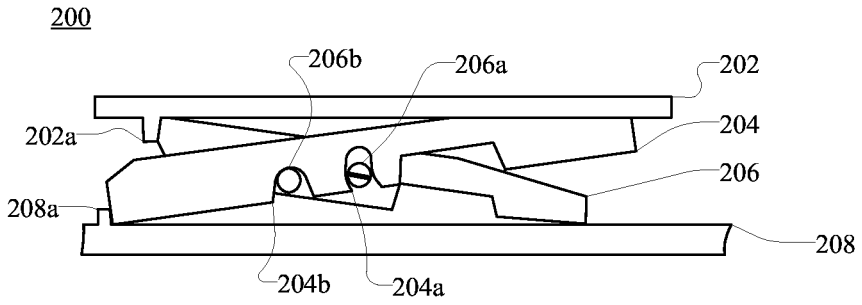
FIG. 2A depicts a side cross-section view of an example scissor mechanism including a pivot track and an up-stop track defining an upper height of a key.

FIG. 2A depicts a side cross-section view of an example key 200. The key 200 may include a key cap 202 having at least one retaining feature 202*a*. The key cap 202 may be constructed of any suitable material. For example, in certain embodiments, the key cap 202 may be constructed of metal, plastic, glass, crystal, wood, ceramic, or other materials or combinations of materials. One may appreciate that the material selected for the key cap 202 may be preferably durable, as the key 200 may be depressed thousands of times over the operational live of the key cap 202.

The key cap 202 may be disposed above a scissor mechanism defined by the scissor members 204, 206. The scissor member 204 may be positioned to interface with a bottom surface of the key cap 202. For example, the scissor member 204 may include a partially angled top surface such that when the key 200 is in an "up" position, the angled portion is parallel to a bottom surface of the key cap 202. In this manner, the geometry selected for the scissor member 204 may aid in the structural support the key cap 202.

The scissor member 206 may interface with the retaining feature 202*a*. In this manner, when the keycap is depressed, the scissor member 206 may pivot at the retaining feature 202*a* to collapse the scissor mechanism of the key 200 downward.

The scissor mechanism may be disposed above a baseplate 208 which also may include at least one retaining feature 208*a*. The base plate, or feature plate, may be constructed of a number of suitable materials. In certain examples, the base plate may be composed of a single material, or in other examples, the base plate may be composed of a stack of different materials. For example, in certain embodiments, the base plate 208 may be constructed of a metal such as aluminum or steel. In these cases, the retaining feature 208*a* may be made of the same or a different material as the base plate 208. For example, the base plate 208 may be metal and the retaining feature 208*a* may be plastic. If the retaining feature 208*a* and the base plate 208 are made from different materials, the two may be coupled together using any suitable process. For example, certain embodiments may include a configuration in which the retaining feature 208*a* is adhered to the base plate 208 with an adhesive. In some embodiments, the retaining feature may be mechanically fastened to the base plate with a fastening means such as a screw or clip. In still further embodiments, the retaining feature 208*a* may be welded or otherwise bonded to the base plate 208.

Some embodiments include a configuration in which the base plate 208 includes at least one electrically insulating layer disposed along one or more surfaces of the base plate 208. In such examples, the base plate 208 may include one or more layers associated with electrical switch circuitry.

The base plate 208 and the retaining feature 208*a* may interface with one or both of the scissor members 204, 208. For example, as illustrated, the scissor member 204 may interface with and pivot at the retaining feature 208*a* during depression of the key cap, for example as shown within FIGS. 2A-2C. In this manner, one may appreciate that because the scissor member 204 pivots at the retaining feature 208*a* and because the scissor member 206 pivots at the retaining feature 202*a*, that the scissor mechanism may slide away from the retaining features during depression of the key.

As illustrated in FIG. 2A, the retaining features 202*a* and 208*a* of the key cap 202 and the base plate 208 respectively are depicted as formed along the same side of the scissor mechanism. However, one may appreciate that alternate and additional configurations are contemplated. For example, in certain embodiments, the base plate 208 may include retaining feature 208*a* that is positioned to interface with the scissor member 206. In these embodiments, the scissor member 206 may pivot with respect to the key cap 202 at the retaining feature 202*a*, and may also pivot with respect to the base plate 208 at the retaining feature 208*a*.

In many embodiments, and as illustrated in FIG. 2A, the scissor members 204, 206 may at least partially interlock. For example, scissor member 204 may define at least a pivot track 204*a* and an up-stop track 204*b*. The scissor member 206 may include extension portions 206*a*, 206*b* respectively positioned within the pivot track 204*a* and up-stop track 204*b*.

The pivot track 204*a* may include a mouth portion and an end portion. The mouth portion may be opened within a bottom surface of the scissor member 204. The end may be separated from the mouth by n track that may be at least partially curved. In some embodiments, the track may be at least partially angled with respect to a bottom surface of the scissor member 204*a*. One may appreciate that the angular or curved relationship between the pivot track 204*a* and the bottom surface of the scissor member 204 may be selected in order to define the path of the scissor mechanism as it is compressed, for example as shown through FIGS. 2A-2C.

In many embodiments, the up-stop track 204*b* may include a mouth portion and end portion. The mouth may be opened within a bottom surface of the scissor member 204. The end portion may be positioned approximately halfway through the height of the scissor member 204 relative to the bottom surface. In some embodiments, the end portion may be positioned higher or lower relative to the bottom surface.

The extension portion 206*b* may be sized to fit within the up-stop track 204*b* such that when the key is in the upper position, the end portion of the up-stop track 204*b* and the extension portion 206*b* may impact one another, completely arresting further extension of the scissor mechanism. In this manner, the up-stop track may stop upward motion of the key cap 202, rigidly fixing the height of the key 200.

In many embodiments, the scissor mechanisms 204, 206 may interlock. For example, the scissor member 204 may include an aperture sized to receive the scissor member 206. In some embodiments, scissor member 204 may fit within an aperture of the scissor member 206. In still further embodiments, the scissor members 204, 206 may partially overlap one another.

One may appreciate that many conventional scissor mechanisms interlock and pivot about a fixed point. Accordingly, scissor members must be constructed of a compliant material such that, during manufacture, one scissor member can be temporarily deformed and inserted within the other scissor member. Complaint materials may also be required in order to install the scissor mechanism within the respective keyboard. One may further appreciate that compliant materials may experience deformation over time, potentially allowing the height of individual keys to undesirably drift over time.

However, for many embodiments described herein, the scissor members 204, 206 are not required to be made from complaint materials because the interlocking geometry of the scissor members 204, 206 allow the use of rigid or otherwise non-compliant materials. Specifically, rigid materials may be used because the mouth portions of the pivot track 204*a* and up-stop track 204*b* eliminate the requirement that one scissor member be deformed to be inserted within the other.

For example, the scissor member 204 may be merely placed above the scissor member 206 to align the extension portions 206*a*, 206*b* with the pivot track 204*a* and up-stop track 204*b* respectively. In this manner, the scissor member 204 may slide to interlock with the scissor member 206. Because the scissor mechanism may be assembled without deforming either scissor member, the scissor members 204, 206 may be constructed of a non-compliant material that resists deformation over time and substantially reduces the risk of height drift as experienced by traditionally designed keyboard scissor mechanisms.

In these embodiments, the scissor member 204, 206 may be constructed of metal or glass-filament doped plastic. The scissor members 204, 206 may be formed by injection molding, laser cutting, stamping, or any other suitable process.

Figure 2B:
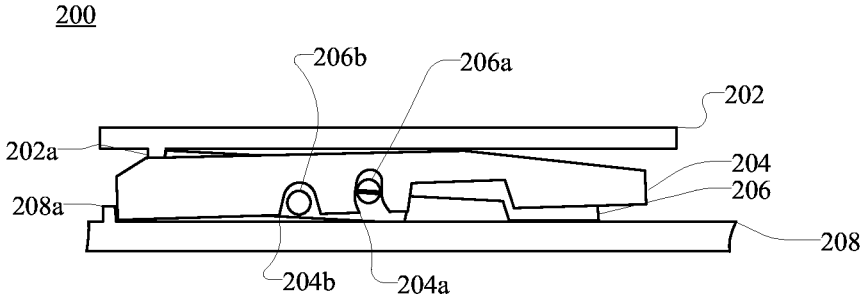
FIG. 2B depicts the example scissor mechanism of FIG. 2A, showing the scissor mechanism partially compressed.

FIG. 2B depicts the example scissor mechanism of FIG. 2A shown partially compressed in response to a downward force received at the upper surface of the key cap 202. When the key 200 is depressed, the extension portion 206*a* may slide and at least partially pivot within with pivot track 204*a* as the scissor member 204 pivots at the retaining feature 208*a* and the scissor member 206 pivots at the retaining feature 202*a*.

Figure 2C:
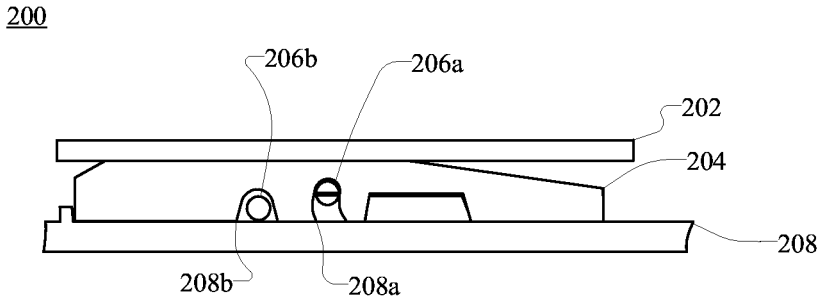
FIG. 2C depicts the example scissor mechanism of FIG. 2A, showing the scissor mechanism fully compressed.

As the downward force continues, the scissor mechanism may continue to compress. For example, FIG. 2C depicts the scissor mechanism of FIG. 2A mechanism fully compressed. As illustrated, the end portion of the pivot track 204*a* interfaces with the extension portion 206*a*. Although illustrated showing the scissor member 204 as parallel with the base portion 208, one may appreciate that the end portion of the pivot track 204*a* may operate as a down-stop if positioned closer to the bottom surface of the scissor member 204.

For example, if the end portion pivot track 204*a* is positioned more proximate to the bottom surface of the scissor member 204, the travel distance of the key 200 may be fixed.

Figure 2D:
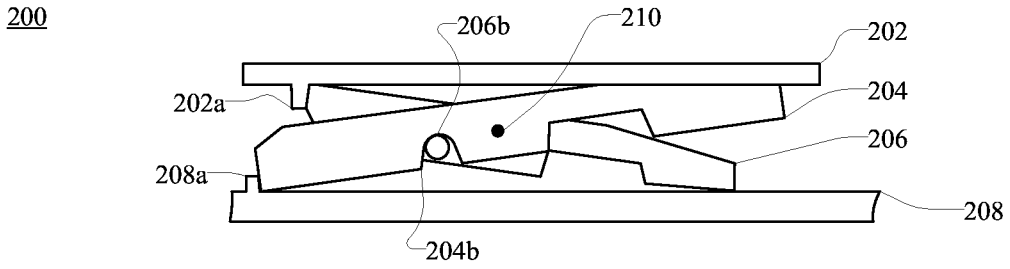
FIG. 2D depicts a side cross-section view of an alternate example scissor mechanism including an up-stop track defining an upper height of a key.

FIG. 2D depicts a side cross-section view of an alternate example scissor mechanism including an up-stop track defining an upper height of a key. The key 200 may include a key cap 202 having at least one retaining feature 202*a*. The key cap 202 may be constructed of any suitable material. For example, in certain embodiments, the key cap 202 may be constructed of metal, plastic, glass, crystal, wood, ceramic, or other materials or combinations of materials. One may appreciate that the material selected for the key cap 202 may be preferably durable, as the key 200 may be depressed thousands of times over the operational live of the key cap 202.

The key cap 202 may be disposed above a scissor mechanism defined by the scissor members 204, 206. The scissor member 204 may include a partially angled top surface such that when the key 200 is in an "up" position, the angled portion is parallel to a bottom surface of the key cap 202. In this manner, the geometry selected for the scissor member 204 may aid in the structural support the key cap 202.

The scissor member 204 may be positioned to interface with a bottom surface of the key cap 202, and may be configured to pivot with respect to the scissor member 206 about a fixed pivot point 210. In this manner, as the key is depressed, the scissor member 204 and scissor member 206 may compress downwardly by pivoting about the pivot point 210. In many examples, the pivoting motion of the scissor members 204, 206 about the pivot point 210 may cause a bottom portion of one or both of the scissor members 204, 206 to slide a certain distance along a base plate 208.

Conventional scissor mechanism designs limit the sliding distance of the bottom portions of one or both scissor members to define the upper height of a key cap. For example, setting a slide stop to impact the sliding portion of one or both of the scissor members may prevent the scissor member from further pivoting, and thus may define an upper height of an associated key. Such designs may be exceptionally dependent upon tight manufacturing tolerance of both the dimensions of the individual scissor members, but also of the placement of the slide stop. In many examples, slight manufacturing variations may cause key high to vary substantially.

Accordingly, embodiments described herein may include an up-stop track 204*b* within the scissor member 204. In many embodiments, the up-stop track 204*b* may include a mouth portion and end portion. The mouth may be opened within a bottom surface of the scissor member 204. The end portion may be positioned approximately halfway through the height of the scissor member 204 relative to the bottom surface. In some embodiments, the end portion may be positioned higher or lower relative to the bottom surface.

Corresponding to the up-stop track 204*b* may be an extension portion 206*b* that extends from the scissor member 206. The extension portion 206*b* may be sized to fit within the up-stop track 204*b* such that when the key is in the upper position, the end portion of the up-stop track 204*b* and the extension portion 206*b* may impact one another, completely arresting further extension of the scissor mechanism. In this manner, the up-stop track may stop upward motion of the key cap 202, rigidly fixing the height of the key 200 without limiting the sliding distance of the bottom portion of either scissor member. In other words, when the key 200 is depressed and subsequently released, the scissor mechanism may begin to expand to restore the original height of the keycap 202. As the scissor mechanism expands the individual scissor members 204, 206 may pivot about the pivot point 210 in the opposite direction to compression. As the scissor members 204, 206 continue to expand, the extension portion 206*b* may engage with, enter or otherwise slide into the mouth portion of the up-stop track 204*b*. As the scissor members continue to expand, the extension portion 206*b* may impact the end portion of the up-stop track 204*b*, thus arresting further upward motion of the keycap 202. In this manner, the up-stop track may define the upper height of the key.

In many embodiments, the scissor mechanisms 204, 206 may interlock. For example, the scissor member 204 may include an aperture sized to receive the scissor member 206. In some embodiments, scissor member 204 may fit within an aperture of the scissor member 206. In still further embodiments, the scissor members 204, 206 may partially overlap one another.

Figure 3:
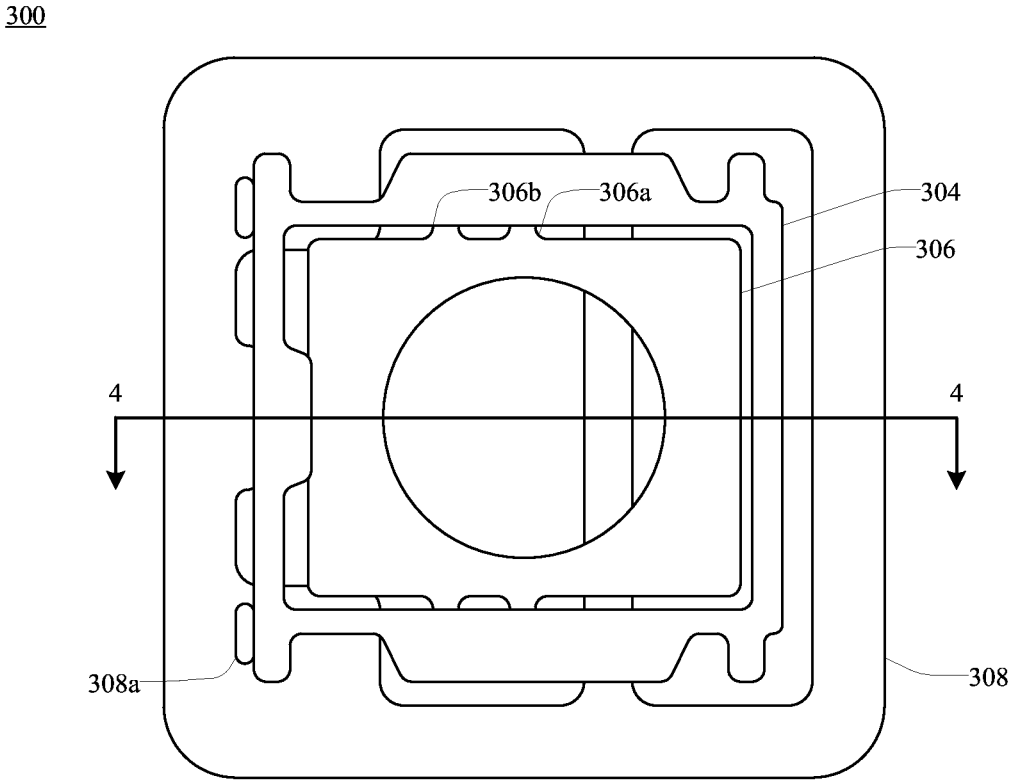
FIG. 3 depicts a top plan view of an example scissor mechanism showing two interlocking scissor members of an example scissor mechanism.

FIG. 3 depicts a top plan view of an example scissor mechanism 300 showing two interlocking scissor members, an external scissor member 304 and an internal scissor member 306, positioned above a base plate 308. The base plate may include one or more retaining features 308*a*. As illustrated, the external scissor member 304 may receive the internal scissor member 306, which may include one or more extension portions 306*a*, 306*b* that interlock with the portions of the external scissor member 304.

In these and related embodiments, the internal scissor member 306 may also include a central aperture. In many cases, an elastomeric dome switch may be positioned below or within the aperture of the internal scissor member 305.

Figure 4:
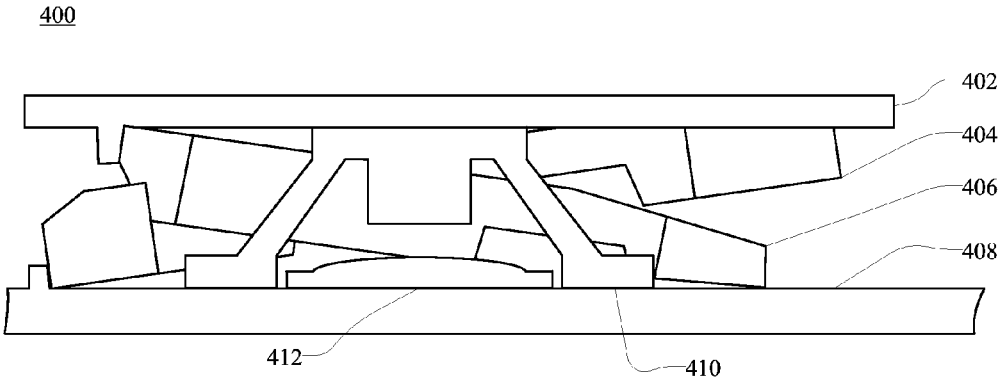
FIG. 4 depicts a side cross-section view of the scissor members of FIG. 3 taken along line 4-4 showing an elastomeric dome switch positioned within overlapping apertures of the interlocking scissor mechanism.

FIG. 4 depicts a side cross-section view of the scissor members of FIG. 3 taken along line 4-4 showing a key 400 including an elastomeric dome 410 switch positioned within overlapping apertures of the interlocking scissor mechanism. The elastomeric dome 410 may be a dome that provides tactile feedback when the elastomeric dome 410 is mechanically compressed. In many cases, the elastomeric dome 410 may be make from a complaint and compressible material such as a rubber. In many cases, the elastomeric dome 410 may be positioned above electrical switch circuitry 412 such that when the key cap 402 is compressed downwardly, the elastomeric dome 410 may translate the compression force to a top surface of the electrical switch circuitry in order to complete an electrical circuit.

Figure 5:
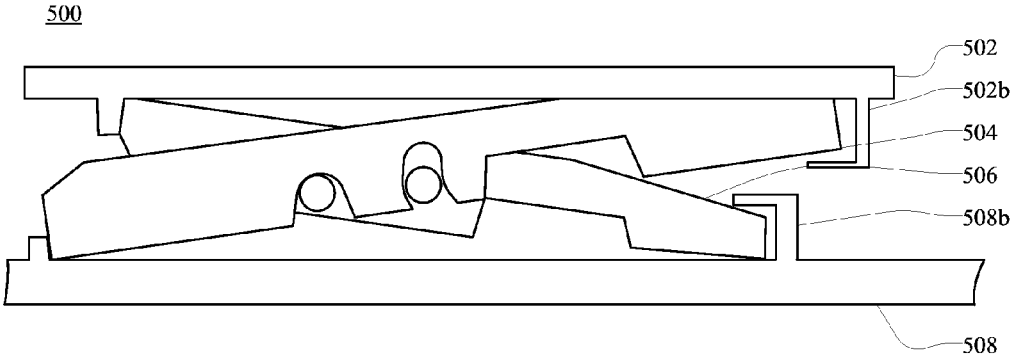
FIG. 5 depicts a side cross-section view of an example scissor mechanism positioned to interface at least one retaining feature of a base plate disposed below.

In further embodiments, additional retaining features may be included along the key cap or the base plate in order to prevent the key cap from undesirable or accidental disassembly of the key. For example, FIG. 5 depicts a side cross-section view of an example scissor mechanism positioned to interface at least one retaining feature 508*b* of a base plate 508 disposed below, and also positioned to interface at least one retaining feature 502*b* along the key cap positioned above. Each of the retaining features 502*b*, 508*b* may be positioned to allow respective portions of the scissor mechanism (e.g., the scissor members 504, 506) to slide a small distance within the retaining feature during compression of the key 500. One may appreciate that although two additional retaining features are depicted, that the number, geometry, and positioning of retaining features may vary from embodiment to embodiment.

Figure 6:
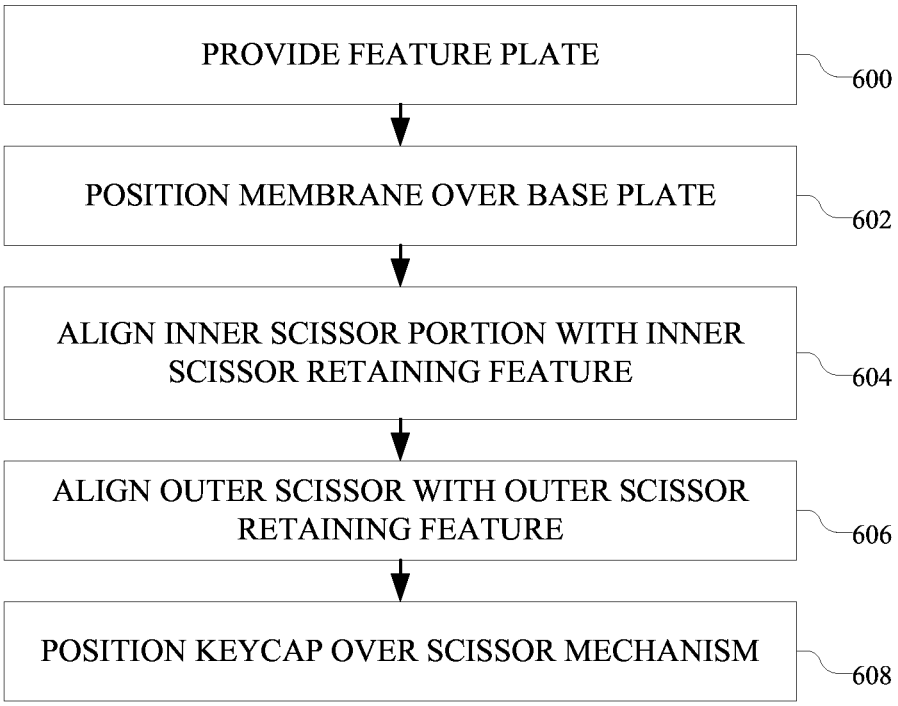
FIG. 6 is a process flow diagram illustrating example steps of a method of assembling a scissor mechanism for keyboards requiring uniform height of adjacent keys.

FIG. 6 is a process flow diagram illustrating example steps of a method of assembling a scissor mechanism for keyboards requiring uniform height of adjacent keys. The process may begin at step 600, in which a feature plate, or base plate, is selected. Thereafter, at step 602, a membrane including one or more elastomeric domes may be positioned over the base plate. Next, at step 604, an inner scissor portion (or member) may be aligned with a retaining feature present along the feature plate. Next, at 606, an outer scissor member may be aligned with an outer scissor a different retaining feature. Lastly, at 608, a keycap may be positioned over the scissor mechanism.

One may appreciate that although many embodiments are disclosed above, that the operations and steps presented with respect to methods and techniques described herein are meant as exemplary and accordingly are not exhaustive. One may further appreciate that alternate step order or, fewer or additional steps may be required or desired for particular embodiments.

Although the disclosure above is described in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the some embodiments of the invention, whether or not such embodiments are described and whether or not such features are presented as being a part of a described embodiment. Thus, the breadth and scope of the present invention should not be limited by any of the above-described exemplary embodiments but is instead defined by the claims herein presented.

We claim:

1. A key comprising:

a keycap;

a scissor mechanism disposed below the keycap and comprising:

a first scissor member defining a pivot track and an up-stop track; and a second scissor member comprising a first extension portion positioned within the pivot track and a second extension portion positioned within the up-stop track; and an elastomeric dome disposed at least partially below the scissor mechanism; wherein the second extension portion engages the up-stop track to limit an upward stroke of the key.

2. The key of claim 1, further comprising a retaining feature to pivotally interface with an end portion of the second scissor member.

3. The key of claim 1, further comprising a baseplate disposed below the scissor mechanism.

4. The key of claim 1, wherein the second scissor member is sized to at least partially fit within an aperture defined by the first scissor member.

5. The key of claim 1, wherein the first scissor member is sized to at least partially fit within an aperture defined by the second scissor member.

6. The key of claim 1, wherein the first scissor member at least partially overlaps a portion of the second scissor member.

7. A scissor mechanism for a key comprising:

a first scissor member comprising a pivot track and a stopper track; and a second scissor member comprising a first extension portion positioned within the pivot track and a second extension portion positioned within the stopper track;

wherein:

upon compression of the scissor mechanism, the first extension portion at least partially pivots and at least partially slides within the pivot track; and the second extension portion at least partially slides within the stopper track and defines a limit to an expansion of the scissor mechanism by engaging a portion of the stopper track.

8. The scissor mechanism of claim 7, wherein an end portion of the second scissor mechanism is configured to pivotally interface with a retaining feature of a keycap.

9. The scissor mechanism of claim 7, wherein the pivot track is at least partially curved.

10. The scissor mechanism of claim 7, wherein the pivot track is at least partially angled with respect to a bottom surface of the first scissor member.

11. The scissor mechanism of claim 7, wherein the second scissor member is sized to at least partially fit within an aperture within the first scissor member.

12. The scissor mechanism of claim 7, wherein the first scissor member is sized to at least partially fit within an aperture within the second scissor member.

13. The scissor mechanism of claim 7, wherein the first scissor member at least partially overlaps a portion of the second scissor member.

14. A method of assembling a key comprising:

positioning a membrane over a base plate comprising a first and second retaining feature;

positioning, over the membrane, a scissor mechanism comprising:

a first scissor member comprising a pivot track and a stopper track; and a second scissor member comprising a first extension portion positioned within the pivot track and a second extension portion positioned within the stopper track, the stopper track configured to define an upper height of the key when the second extension portion engages a portion of the stopper track;

aligning a first end of the first scissor member with the first retaining feature; and aligning a first end of the second scissor member with the second retaining feature.

15. A keyboard comprising:

a plurality of keys, each key comprising:

a keycap;

a scissor mechanism disposed below the keycap and comprising:

a first scissor member comprising a pivot track and an up-stop track; and a second scissor member comprising a first extension portion positioned within the pivot track and a second extension portion positioned within the up-stop track;

an elastomeric dome disposed at least partially below the scissor mechanism; and electronic switch circuitry disposed below the elastomeric dome, wherein:

the up-stop track constrains movement of the scissor mechanism due to an engagement of the up-stop track with the second extension portion.

16. The keyboard of claim 15, each keycap of each of the plurality of keys further comprising a retaining feature to pivotally interface with an end portion of the second scissor member.

17. The keyboard of claim 15, further comprising a baseplate disposed below the plurality of keys.

18. The keyboard of claim 17, the baseplate further comprising a plurality of retaining features, each retaining feature positioned to pivotally interface with an end portion of a respective first scissor member of a respective one key of the plurality of keys.

19. A keyboard comprising:

a plurality of keys, each key comprising:

a keycap;

a scissor mechanism disposed below the keycap and comprising:

a first scissor member comprising an up-stop track; and a second scissor member comprising an extension portion positioned within the up-stop track;

an elastomeric dome disposed at least partially below the scissor mechanism; and electronic switch circuitry disposed below the elastomeric dome;

wherein:

the first scissor member and the second scissor member are coupled to pivot about a fixed point with respect to one another; and the extension portion contacts a portion of the upstop to limit an upper stroke of the key.

20. The keyboard of claim 19, each keycap of each of the plurality of keys further comprising a retaining feature to slidably interface with an end portion of the second scissor member.

* * * * *